US009732591B2

(12) United States Patent
Mouton et al.

(10) Patent No.: US 9,732,591 B2
(45) Date of Patent: Aug. 15, 2017

(54) HYDROSTATIC TUBULAR LIFTING SYSTEM

(71) Applicant: Weatherford Technology Holdings, LLC, Houston, TX (US)

(72) Inventors: David E. Mouton, Missouri City, TX (US); Federico Amezaga, Cypress, TX (US); Jim Hollingsworth, Cypress, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 14/109,701

(22) Filed: Dec. 17, 2013

(65) Prior Publication Data

US 2014/0318800 A1 Oct. 30, 2014

Related U.S. Application Data

(60) Provisional application No. 61/739,478, filed on Dec. 19, 2012.

(51) Int. Cl.

| | |
|---|---|
| ***E21B 17/07*** | (2006.01) |
| ***E21B 41/00*** | (2006.01) |
| ***E21B 33/038*** | (2006.01) |
| ***E21B 33/06*** | (2006.01) |
| ***E21B 17/02*** | (2006.01) |

(52) U.S. Cl.

CPC ..... *E21B 41/0007* (2013.01); *E21B 17/02* (2013.01); *E21B 17/07* (2013.01); *E21B 33/038* (2013.01); *E21B 33/06* (2013.01)

(58) Field of Classification Search

CPC ..... E21B 17/07; E21B 34/045; E21B 41/0007
USPC ..... 166/339, 345, 367, 98, 301; 294/86.1
See application file for complete search history.

(56) References Cited

U.S. PATENT DOCUMENTS

| | | | | |
|---|---|---|---|---|
| 2,377,249 | A | 3/1945 | Bruen | |
| 2,595,014 | A * | 4/1952 | Smith et al. | 166/98 |
| 2,806,534 | A | 9/1957 | Potts | |
| 2,901,044 | A | 4/1959 | Arnold | |
| 2,915,126 | A | 12/1959 | Potts | |
| 3,073,134 | A * | 1/1963 | Mann | 464/18 |
| 3,354,950 | A * | 11/1967 | Hyde | E21B 17/07 166/336 |

(Continued)

FOREIGN PATENT DOCUMENTS

| | | | |
|---|---|---|---|
| GB | 2362401 | A | 11/2001 |
| WO | 00-09853 | A1 | 2/2000 |

(Continued)

OTHER PUBLICATIONS

PCT International Search Report and Written Opinion for Application PCT/US2013/076597, dated May 27, 2014.

(Continued)

*Primary Examiner* — Matthew R Buck

(74) *Attorney, Agent, or Firm* — Patterson & Sheridan, LLP

(57) ABSTRACT

In one embodiment, a tubular lifting system for lifting a wellbore tubular includes an outer tubular; an inner tubular disposed in the outer tubular; an annular chamber defined between the inner tubular and the outer tubular; and a tubular piston selectively movable in the annular chamber, wherein the wellbore tubular is connected to the tubular piston and movable thereby.

23 Claims, 11 Drawing Sheets

(56) References Cited

U.S. PATENT DOCUMENTS

| | | | | | |
|---|---|---|---|---|---|
| 3,752,230 | A | | 8/1973 | Bernat et al. | |
| 3,797,570 | A | | 3/1974 | Leutwyler | |
| 4,055,338 | A | * | 10/1977 | Dyer | 267/125 |
| 4,367,981 | A | * | 1/1983 | Shapiro | 405/224.2 |
| 5,070,941 | A | | 12/1991 | Kilgore | |
| 5,311,954 | A | * | 5/1994 | Quintana | E21B 4/18 166/383 |
| 5,577,566 | A | * | 11/1996 | Albright et al. | 175/321 |
| 5,673,754 | A | | 10/1997 | Taylor, Jr. | |
| 6,003,607 | A | * | 12/1999 | Hagen | E21B 17/07 166/120 |
| 7,021,382 | B2 | * | 4/2006 | Angman et al. | 166/301 |
| 8,727,014 | B2 | * | 5/2014 | Edwards | 166/350 |
| 8,733,447 | B2 | * | 5/2014 | Mouton et al. | 166/355 |
| 8,757,269 | B2 | * | 6/2014 | Tabor et al. | 166/340 |
| 2009/0255683 | A1 | * | 10/2009 | Mouton et al. | 166/355 |

FOREIGN PATENT DOCUMENTS

| | | | |
|---|---|---|---|
| WO | 02088517 | A1 | 11/2002 |
| WO | 2009126940 | A2 | 10/2009 |

OTHER PUBLICATIONS

Canadian Office Action dated Mar. 2, 2016, for Canadian Patent Application No. 2,889,940.

Australian Patent Examination Report dated Dec. 11, 2015, for Australian Patent Application No. 2013361315.

* cited by examiner

80

HYDROSTATIC TUBULAR LIFTING SYSTEM

CROSS-REFERENCE TO RELATED APPLICATIONS

This application claims benefit of U.S. provisional patent application Ser. No. 61/739,478, filed Dec. 19, 2012, which patent application is herein incorporated by reference in its entirety.

BACKGROUND OF THE INVENTION

Field of the Invention

Embodiments of the present invention generally relates to an apparatus and method for lifting a tubular. Particularly, embodiments of the present invention relates to lifting a tubular out of a wellhead.

Description of the Related Art

As oil and gas production is taking place in progressively deeper water, floating rig platforms are becoming a required piece of equipment. Floating rig platforms are typically connected to a wellhead on the ocean floor by a tubular called a drilling riser. The drilling riser is typically heave compensated due to the movement of the floating rig platform relative to the wellhead by using equipment on the floating rig platform. Running a completion assembly or string of tubulars through the drilling riser and suspending it in the well is facilitated by using a landing string. Subsequent operations through the landing string may require high pressure surface operations such as well testing, wireline or coil tubing work.

The landing string is also heave compensated due to the movement of the floating rig platform (caused by ocean currents and waves) relative to the wellhead on the ocean floor. Landing string compensation is typically done by a crown mounted compensator (CMC) or active heave compensating drawworks (AHD). If any high pressure operations will be performed through the landing string, then the high pressure equipment also needs to be rigged up to safely contain these pressures. Since the landing string is moving relative to the rig floor, the compensation is provided through the hook/block, devices such as long bails or coil tubing lift frames are required to enable tension to be transferred to the landing string and provide a working area for the pressure containment equipment.

In some operations, the operator must initiate an autoshear function to shear the tubular in the blow out preventer ("BOP") stack and thereafter, secure the well using blind rams. The sheared tubular above the BOP must be quickly removed from the BOP to avoid damaging the BOP due to lateral movement of the rig or riser. There is a need, therefore, for apparatus and methods of removing a tubular from BOP to avoid damaging the BOP.

SUMMARY OF THE INVENTION

In one embodiment, a tubular lifting system for lifting a wellbore tubular includes an outer tubular; an inner tubular disposed in the outer tubular; an annular chamber defined between the inner tubular and the outer tubular; and a tubular piston selectively movable in the annular chamber, wherein the wellbore tubular is connected to the tubular piston and movable thereby.

In another embodiment, a method of lifting a wellbore tubular includes providing an outer tubular, an inner tubular, and a tubular piston movably disposed between the outer tubular and the inner tubular; connecting the wellbore tubular to the tubular piston; and applying a force to the tubular piston, thereby causing the tubular piston to move axially relative to the outer tubular.

In another embodiment, a tubular lifting system for lifting a wellbore tubular includes an outer tubular; an inner tubular disposed in the outer tubular; and a tubular piston having a first portion disposed between the inner tubular and the outer tubular and a second portion extending beyond the outer tubular, wherein the first portion has a larger piston surface than the second portion, and wherein the wellbore tubular is connected to the tubular piston.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to apparatus and methods for retracting a landing string after shearing by a ram in the blow out preventer ("BOP") or other shearing devices. In one embodiment, a tubular lifting system is connected to a tubular string. In the event the tubular string is severed, for example by a ram in a BOP, the tubular lifting system will lift the tubular portion connected below the lifting system out of the BOP to prevent the tubular portion from interfering with the closing of a blind ram or other types of rams in the BOP.

Figure 1A:
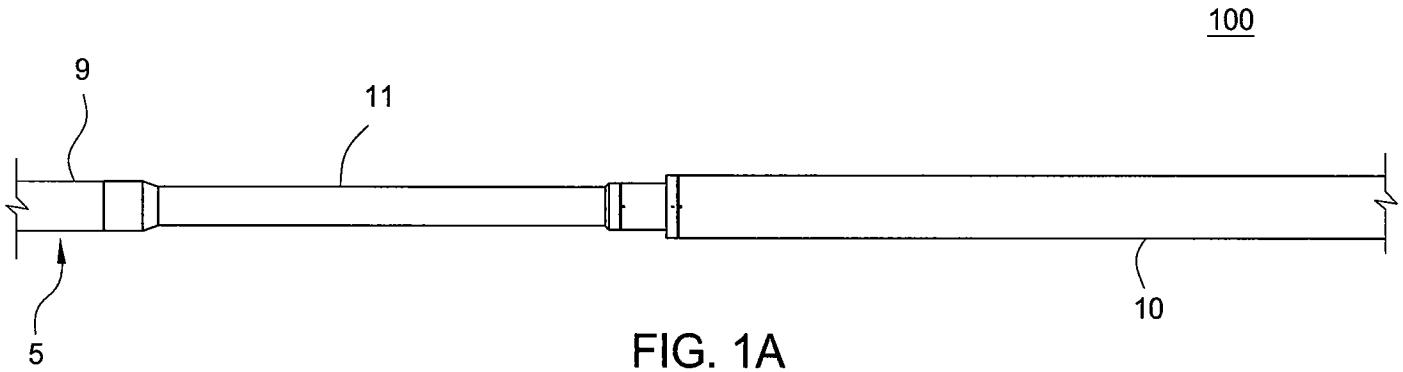
FIGS. 1A-1B are perspective views of an embodiment of a tubular lifting system.
Figure 1C:
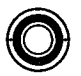
FIG. 1C is a cross-sectional view of the tubular lifting system.
Figure 2A:
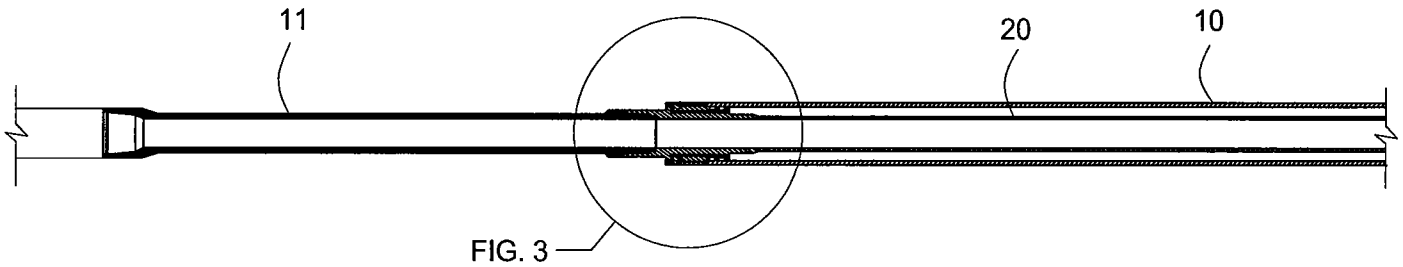
FIGS. 2A-2B are cross-sectional views of the tubular lifting system of FIGS. 1A-1B.
Figure 1B:
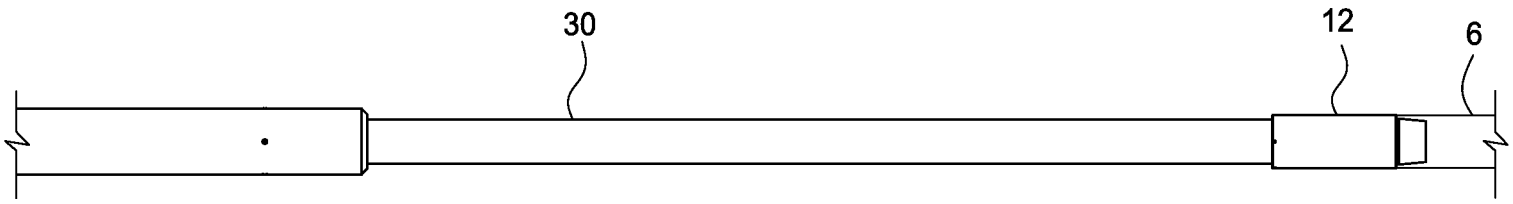
Figure 2B:
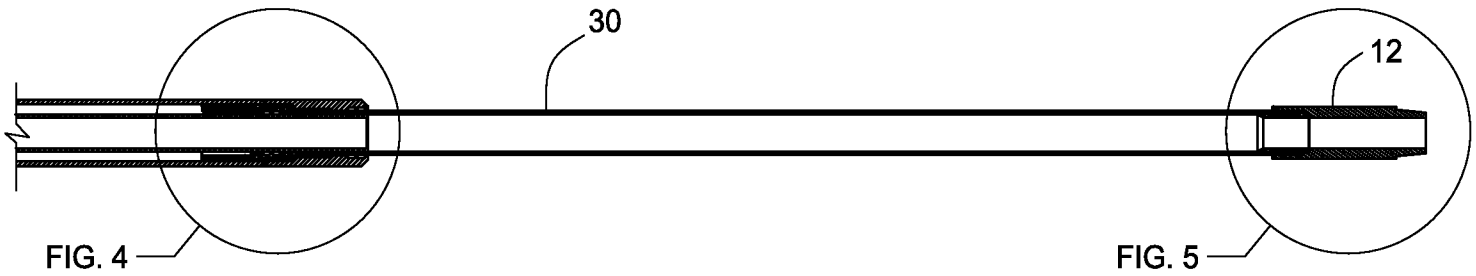
Figure 3:
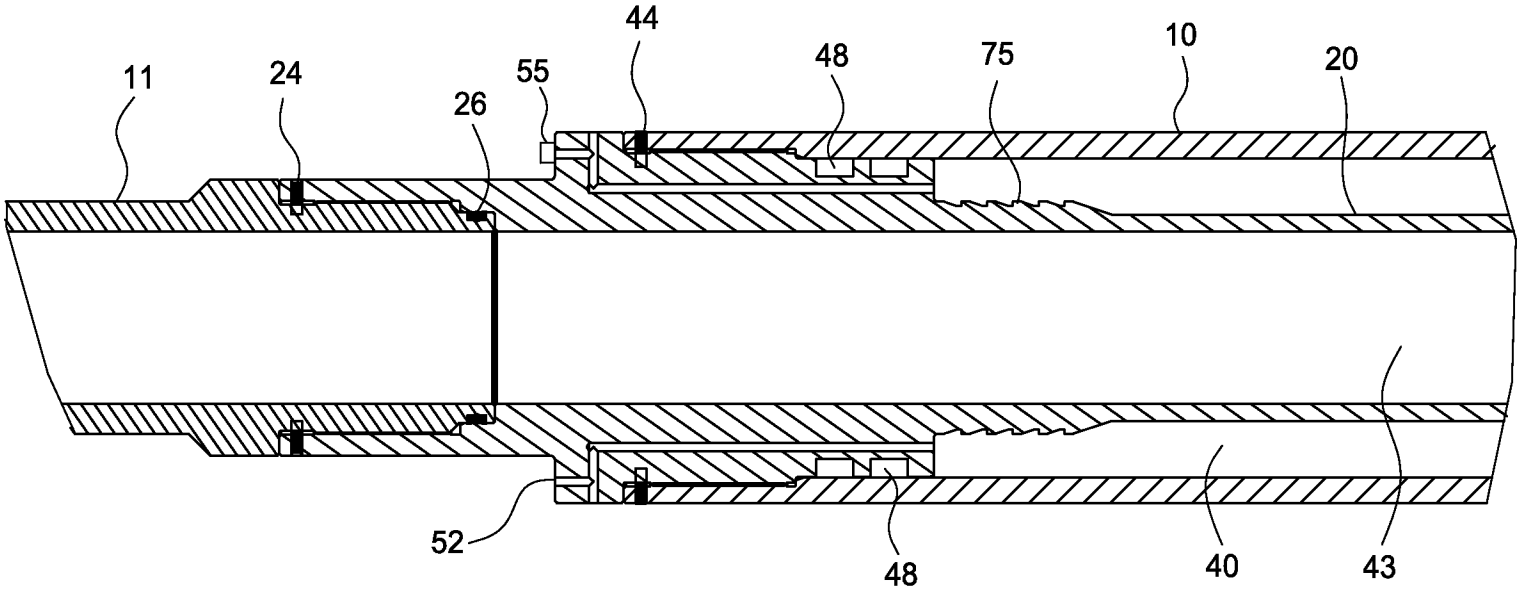
FIG. 3 is an enlarged partial cross-sectional view of an upper portion of the outer tubular of the tubular lifting system of FIGS. 1A-1B.

FIGS. 1A-1B and 2A-2B illustrate an embodiment of a tubular string lifting system 100 suitable for use with a landing string 5. FIGS. 1A-1B are perspective views of the lifting system 100, and FIGS. 2A-2B are cross-sectional views of the lifting system 100. FIG. 1C is a cross-sectional view of the tubular lifting system. FIG. 3 is an enlarged view of the upper portion of the outer tubular 10. The lifting system 100 includes an inner tubular 20 disposed inside an outer tubular 10. The upper end of the inner tubular 20 may be connected to an upper portion of a tubular string such as a landing string 5. The inner tubular 20 has a bore 43 in fluid communication with the bore in the landing string 5. The outer tubular 10 may be connected to the inner tubular 20 using threads, a connection member such as a screw or a pin, or combinations thereof. In one embodiment, an optional cross-over tubular 11 may be used to connect the inner tubular 20 to the upper portion 9 of the landing string 5. The connection may include an optional connection member 24 and a sealing member 26. As shown in FIG. 3, the outer tubular 10 is threaded to the inner tubular 20 in combination with the use of a connection member 44. The inner tubular 20 has an outer diameter that is smaller than an inner diameter of the outer tubular 10 such that an annular chamber 40 is formed between the inner and outer tubulars 10, 20. One or more sealing members 48 such as an o-ring may be used to form a seal between the inner and outer tubulars 10, 20. In one embodiment, one or more channels 52 may be provided for communication between the annular chamber 40 and the exterior of the outer tubular 10. A valve 55 may be provided to control communication through the channels 52. In one embodiment, the annular chamber 40 may have a lower pressure than the pressure in the bore 43. For example, the annular chamber 40 may have a pressure that is less than the riser pressure. In another example, the annular chamber 40 may be at or near atmospheric pressure. In yet another example, the chamber 40 has a pressure between about atmosphere pressure and 1,000 psi. In a further example, the ratio of the hydrostatic pressure to the chamber pressure is from about 6,000:1 to 10:1; preferably from about 4,000:1 to 100:1. In another embodiment, the annular chamber 40 may include nitrogen or other suitable gas such as an inert gas.

Figure 4:
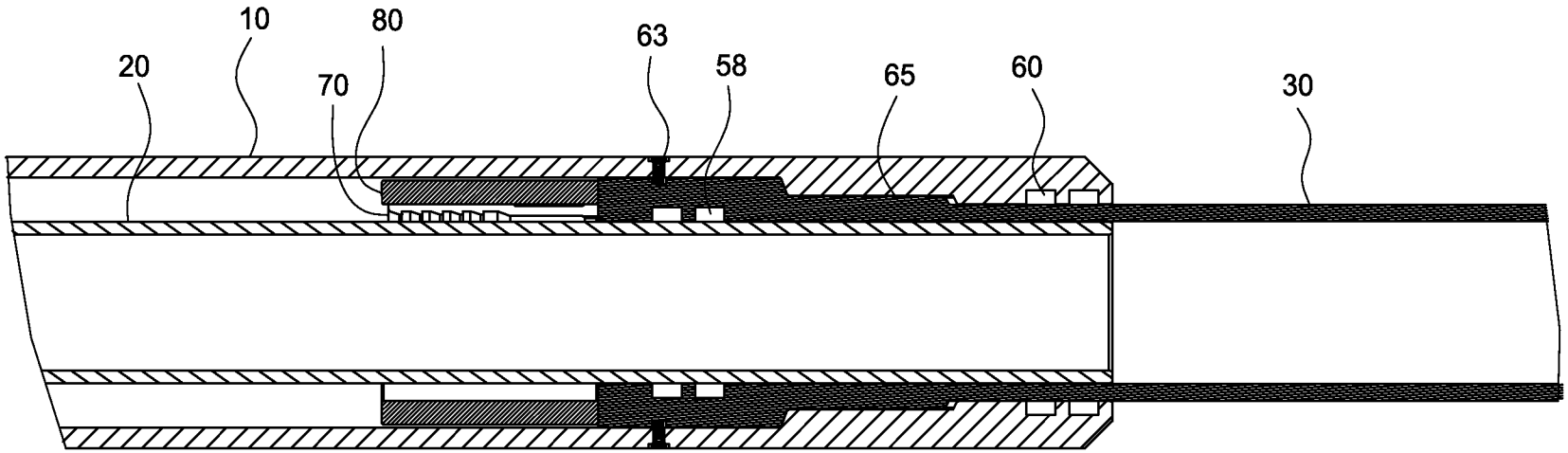
FIG. 4 is an enlarged partial cross-sectional a lower portion of the outer tubular of the tubular lifting system of FIGS. 1A-1B.

FIG. 4 is an enlarged view of the lower portion of the outer tubular 10. A tubular piston 30 is disposed between the inner tubular 20 and the outer tubular 10. In FIG. 4, the tubular piston 30 is shown in the extended position. The upper portion of the tubular piston 30 is coupled to the lower portion of the outer tubular 10. The upper portion of the tubular piston 30 may have a larger outer diameter than a portion of the tubular piston 30 extending below the outer tubular 10. Sealing members 58 such as o-rings may be disposed between the tubular piston 30 and the inner tubular 20, and sealing members 60 may be disposed between the tubular piston 30 and the outer tubular 10. The tubular piston 30 may be rotationally fixed relative to the outer tubular 10. For example, the tubular piston 30 may include splines 65 for coupling with mating splines of the outer tubular 10. The splines allow torque to be transferred from the outer tubular 10 to the tubular piston 30. In another embodiment, the splines may be provided on the inner tubular 20 or on both the inner and outer tubulars 10, 20 for coupling with the tubular piston 30. An optional shearable member 63 such as a shearable screw may be used to selectively connect the tubular piston 30 to the outer tubular 10 to prevent premature retraction of the tubular piston 30, such as during run-in. In one example, after reaching the proper depth, the screw 63 may be sheared by slacking off weight on the landing string. After the screw 63 shears, the tubular piston 30 is allowed to retract relative to the inner and outer tubulars 10, 20, such as by moving upward in the annular chamber 40 in response to a pressure differential. While not intending to be bound by any theory, it is believed that the potential energy of the hydrostatic pressure inside the riser acting against the lower pressure in the pressure chamber 40 will cause upward movement of the tubular piston 30 after shearing of the landing string 5.

Figure 5:
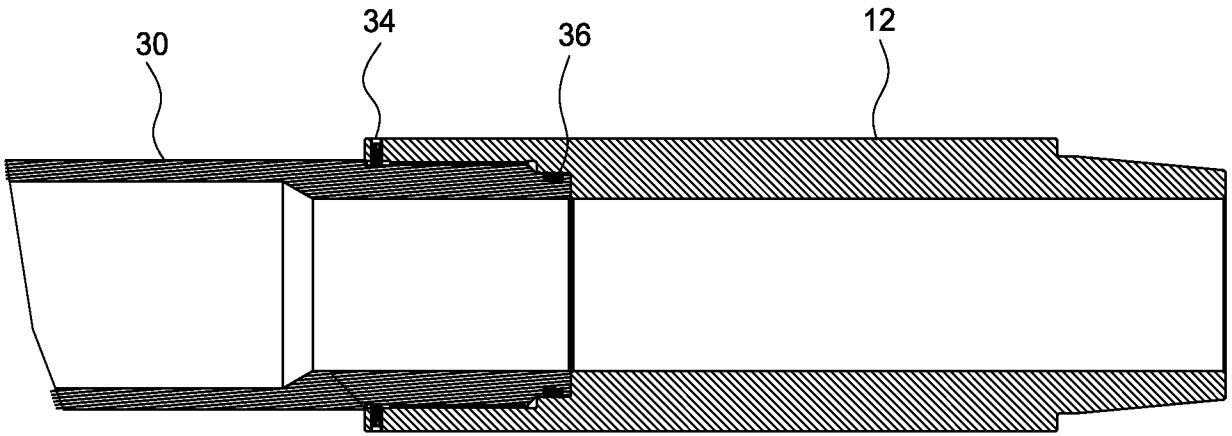
FIG. 5 is an enlarged partial cross-sectional a lower portion of the tubular piston of the tubular lifting system of FIGS. 1A-1B.

FIG. 5 illustrates the lower portion of the tubular piston 30. The tubular piston 30 may include a cross-over tubular 12 for connection to a lower portion 6 of the landing string 5, or may connect directly to the landing string 5. The connection may include an optional connection member 34 and a sealing member 36. The tubular piston 30 may have a total cross-sectional area that is sufficiently sized to lift the lower portion 6 of the landing string 5 in response to the hydrostatic pressure inside the riser. In one embodiment, the distance between the cross-over tubular 12 and the BOP is about one or two joints of the landing string 5. The short distance from the cross-over tubular 12 to the BOP ensures a sufficient lift force is present to lift the landing string 5 or objects connected to the landing string 5 such as a subsea test tree or spanner joint. It is contemplated the lifting system 100 may be positioned at various distances relative to the wellhead to adjust the hydrostatic force exerted on the piston tubular. For example, the lifting system may be positioned closer to the wellhead such that a higher hydrostatic force will be exerted on the piston tubular. Also, because the distance is closer, the lifting system would only need to lift a shorter length of the severed landing string. In another example, the lifting system may be positioned further away from the wellhead such that a lower hydrostatic force will be exerted on the piston tubular. Because distance is further, the lifting system would need to lift a longer length of the severed landing string.

Figure 6B:
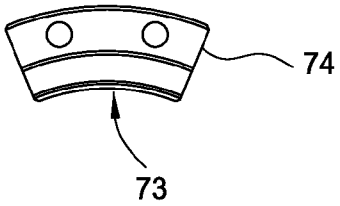
FIGS. 6 and 6A-6C are different views of a retaining member of the tubular lifting system of FIGS. 1A-1B.
Figure 6A:
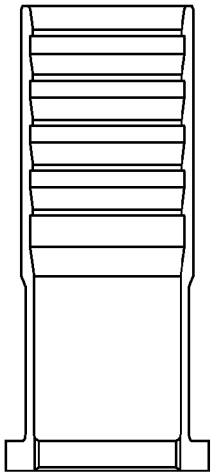
Figure 6C:
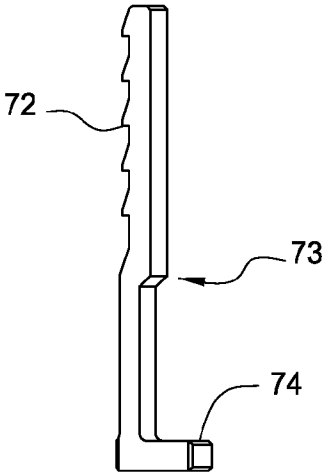
Figure 6:
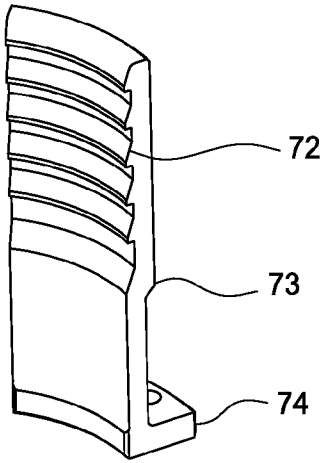

In another embodiment, the tubular piston 30 may optionally include a retaining member 70 such as a ratchet or slips, as shown in FIG. 4. The retaining member 70 may move upward to mate with the mating retaining members 75 such as teeth on the inner tubular 20 (shown in FIG. 3), thereby retaining the tubular piston 30 in the retracted position. A plurality of retaining members 70 may be disposed around the tubular piston 30. FIGS. 6 and 6A-6C show an exemplary embodiment of a retaining member 70. FIG. 6 is a perspective view of the retaining member 70, and FIGS. 6A-6C are, respectively, the front view, the top view, and the side view of the retaining member 70. The retaining member 70 may include an arcuate body 73, teeth 72 on an inner surface of the body 73, and a base 74 for attachment to the tubular piston 30.

Figure 7B:
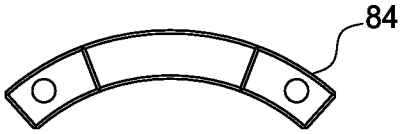
FIGS. 7 and 7A-7C are different views of an impact bar of the tubular lifting system of FIGS. 1A-1B.
Figure 7A:
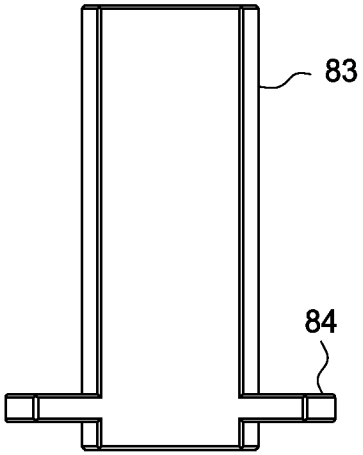
Figure 7C:
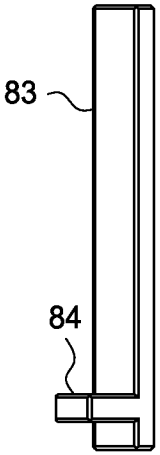
Figure 7:
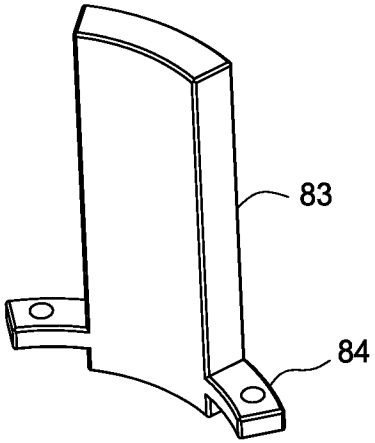

The tubular piston 30 may optionally include contact members 80 such as impact bars. FIGS. 7 and 7A-7C show an exemplary embodiment of a contact member 80. FIG. 7 is a perspective view of the contact member 80, and FIGS. 7A-7C are, respectively, the front view, the top view, and the side view of the contact member 80. A plurality of contact members 80 may be disposed around the tubular piston 30. The contact member 80 may include an arcuate body 83 and a flange 84 for attachment to the tubular piston 30. In one embodiment, the base 74 of retaining member 70 may extend radially below the flange 74 of the contact member 80. In this embodiment, the retaining member 70 is spaced between two adjacent contact members 80. The tubular piston 30 may have four retaining members 70 spaced between four contact members 80. In another embodiment, the contact members 80 may be positioned at a farther radial distance than the retaining members 70. The retaining members 70 and contact members 80 may include holes for receiving a connector such as a screw for attachment to the tubular piston 30. The contact members 80 may extend longitudinally beyond the retaining members 70 so that the contact members 80 may contact the upper end of the inner tubular 20, thereby preventing the retaining members 70 from contact with the upper end of the inner tubular 20.

Figure 8:
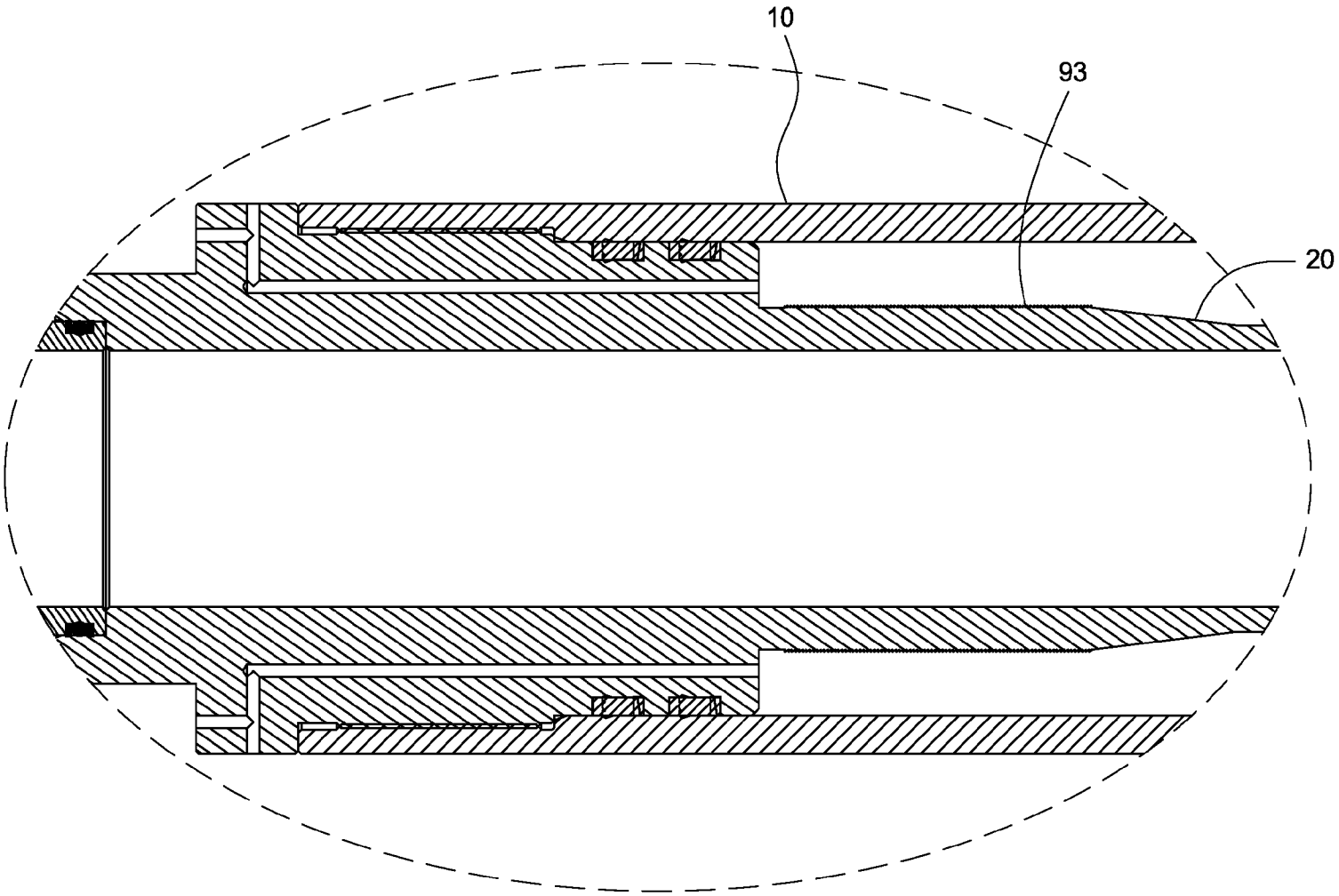
FIG. 8 is an enlarged partial cross-sectional an upper portion of the outer tubular of another embodiment of the tubular lifting system.
Figure 9:
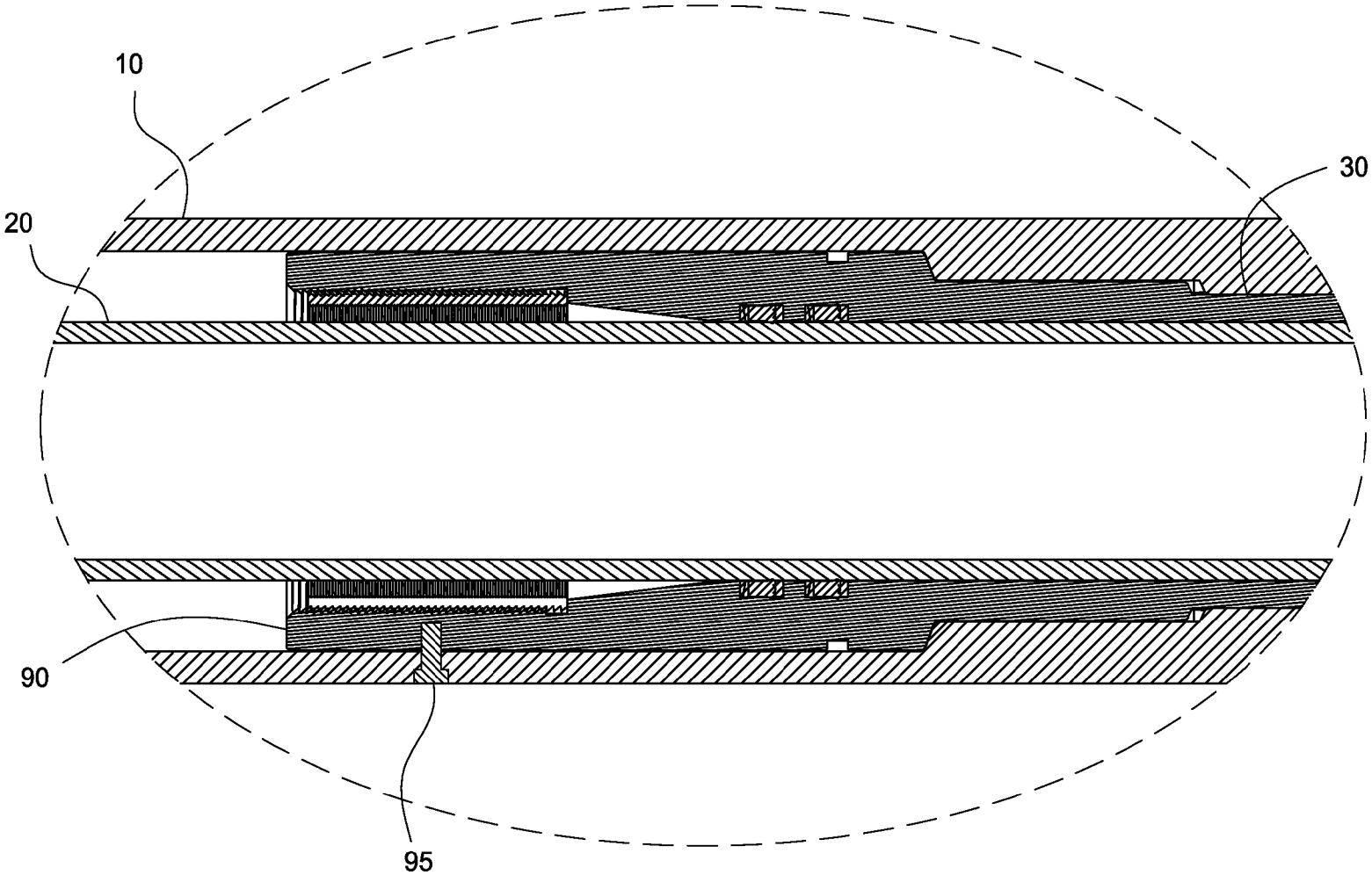
FIG. 9 is an enlarged partial cross-sectional a lower portion of the outer tubular of the tubular lifting system of FIG. 8.
Figure 10:
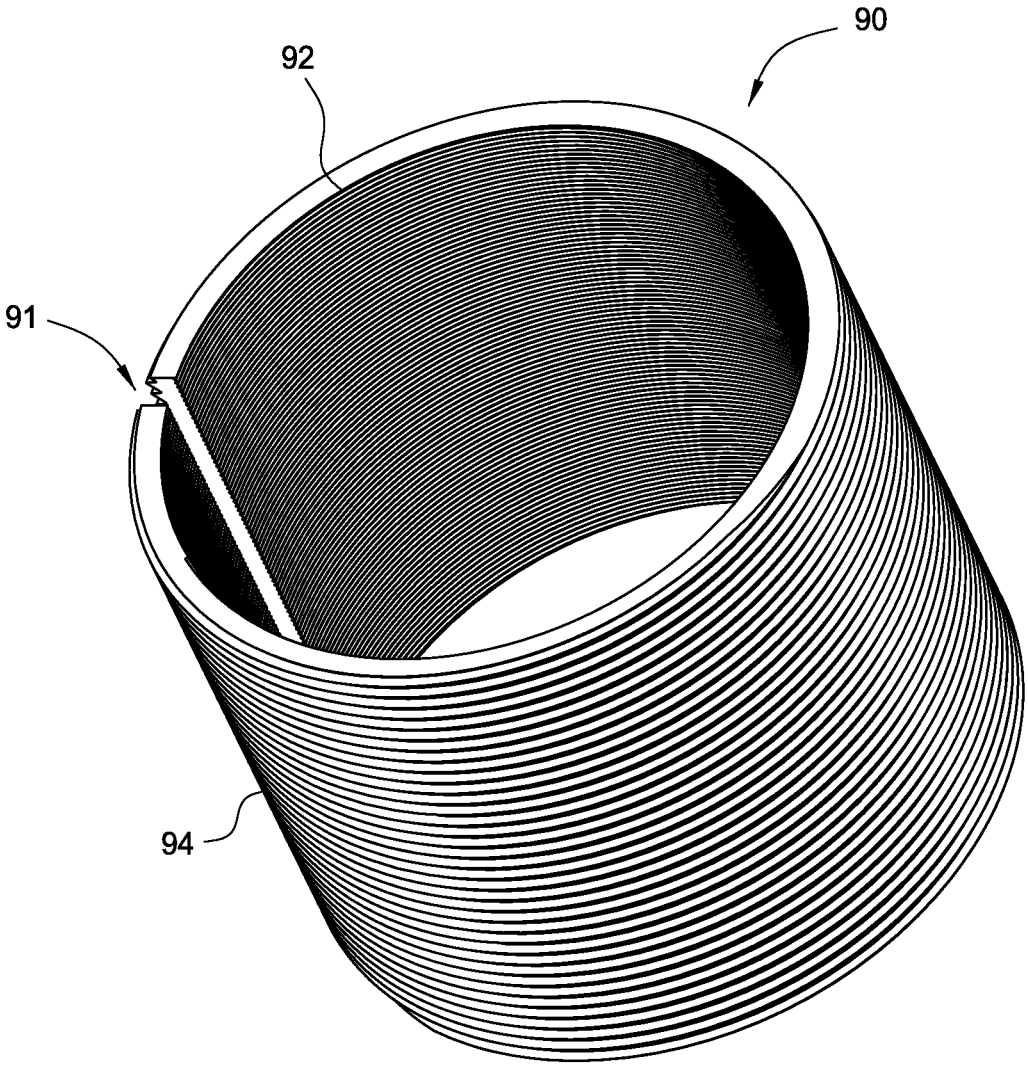
FIG. 10 is a perspective view of a retaining ring of the tubular lifting system of FIG. 8.

FIGS. 8-10 illustrate another embodiment of a retaining member for coupling the piston tubular 30 to the inner tubular 20. In this embodiment, the retaining member is a retaining ring 90 coupled to the piston tubular 30 and is configured to mate with teeth 93 on the inner tubular 20. As shown in FIG. 10, the lock ring 90 has an axial gap 91, teeth 92 on the interior surface, and teeth 94 on the exterior surface. The teeth 94 on the exterior surface are configured to mate with the inner surface of the piston tubular 30, and the teeth 92 on the interior surface are configured to mate with the teeth 93 on the outer surface of the inner tubular 20. The teeth 92, 94 on the interior surface and the exterior surface of the lock ring 90 may be the same or different sizes; for example, the teeth 94 on the exterior surface may be larger than the teeth 92 on the interior surface. In one embodiment, the teeth 92 on the interior surface are configured to allow the piston tubular 30 to move up relative to the inner tubular 20, but not move down. An exemplary teeth 92 formation on the interior surface is a buttress thread. In another embodiment, the teeth 94 on the exterior surface may be threads that mate with corresponding threads on the inner surface of the piston tubular 30. During operation, the axial gap 91 allows the retaining ring 90 to repeatedly expand and retract circumferentially as the teeth 92 of the tubular piston 30 moves along the teeth 93 on the inner tubular. A locking member 95 such as a lock screw or pin may be inserted through the piston tubular 30 and into the axial gap 91 of the retaining ring 90. The locking member 95 prevents the rotation of the retaining ring 90 relative to the piston tubular 30. For example, the locking member 90 may prevent the threads 94 of the locking member from backing out with the threads of the piston tubular 30.

Figure 11B:
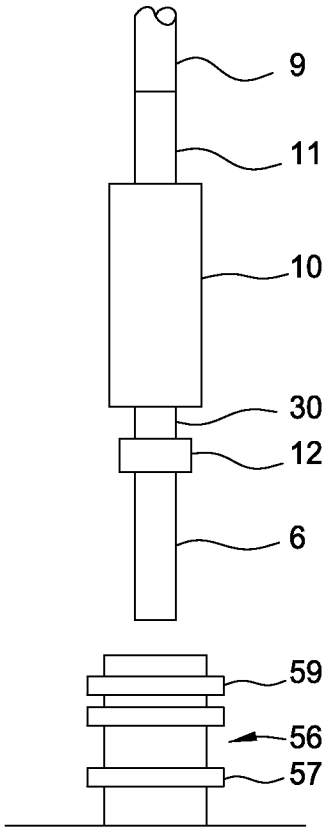
FIGS. 11A-11B illustrate an exemplary tubular lifting system in use with a landing string.
Figure 11A:
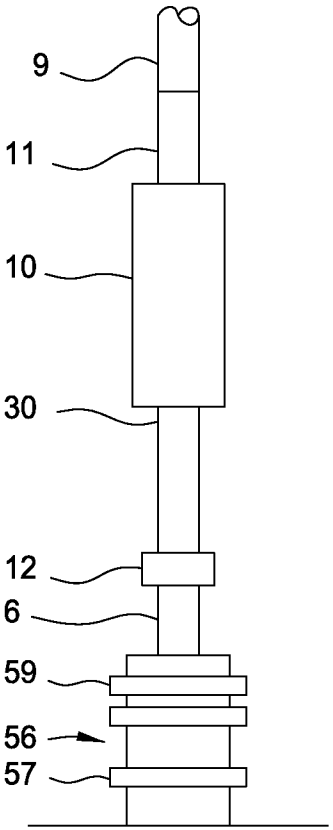

In operation, the lifting system 100 is connected to a landing string 5. As shown in FIG. 11A, a lower portion 6 of the landing string is connected below the tubular lifting system 100 and an upper portion 9 is connected above the tubular lifting system 100. In one embodiment, the lifting system 100 may be used with the landing string described in U.S. Patent Application Publication No. 2009/0255683, published on Oct. 15, 2009, and filed by Mouton et al., which application is incorporated herein by reference in its entirety. The lower portion 6 may extend through a blow out preventer ("BOP") 56. The BOP 56 may include a shear ram 57 for cutting the landing string 5 and a blind ram 59 for closing the BOP 56. The landing string 5 may be disposed in a riser (not shown) which may extend from the rig to the BOP 56. The upper portion 9 of the landing string 5 may be connected to the cross-over tubular 11, and the lower portion 6 of the landing string 5 may be connected to the tubular piston 30 via the lower cross-over tubular 12. Alternatively, either or both portions 6, 9 of the landing string 5 may connect directly to the lifting system 100. During operation, the hydrostatic pressure inside the riser is higher than the pressure inside the pressure chamber 40.

In the event of a drift-off of a vessel, the operator may initiate shearing of the landing string 5 inside the BOP 56 so that the BOP 56 may then be closed. The landing string 5 may be sheared using the shear rams 57. After shearing, the upper severed section of the lower portion 6 must be lifted out of the BOP 56 to avoid damaging the BOP 56. When the landing string 5 is sheared, the pressure differential between the hydrostatic pressure in the BOP 5 and the pressure in the annular chamber 40 applies an upward force on the piston tubular 30. The upward force causes the tubular piston 30 to move upward in the chamber 40 relative to the outer tubular 10. As a result, the severed section of the landing string 5 connected below the tubular piston 30 is lifted upward as well, thereby lifting the severed landing string 5 out of the BOP 56, as shown in FIG. 11B. If the tubular piston 30 is provided with retaining members such as ratchets 70, the ratchets 70 will mate with the mating ratchets 75 on the inner tubular 20, thereby preventing the tubular piston 30 from sliding back down. Also, if the contact members 80 are present, the contact members 80 will contact the upper end of the outer tubular 10 instead of the retaining members 70. If the tubular piston 30 is provided a retaining ring, the retaining ring will mate with the mating threads on the inner tubular 20, thereby preventing the tubular piston 30 from sliding back down. In this manner, the tubular lifting system 100 is configured to quickly lift the severed section of the landing string 5 out of the BOP 56 to prevent damage to the BOP 56 and allow one or more rams 59 to close off the BOP 56. Thereafter, the vessel may initiate lateral movement without damaging the BOP 56.

In one embodiment, a tubular assembly includes a riser; a wellbore tubular disposed in the riser; and a tubular lifting system for lifting the wellbore tubular. In one embodiment, the tubular lift system includes an outer tubular; an inner tubular disposed in the outer tubular; an annular chamber defined between the inner tubular and the outer tubular; and a tubular piston at least partially disposed in the annular chamber and movable relative to the inner tubular, wherein the wellbore tubular is connected to the tubular piston and movable thereby.

In one or more embodiments described herein, the wellbore tubular extends through a blow out preventer.

In one embodiment, a tubular lifting system for lifting a wellbore tubular includes an outer tubular; an inner tubular disposed in the outer tubular; an annular chamber defined between the inner tubular and the outer tubular; and a tubular piston selectively movable in the annular chamber, wherein the wellbore tubular is connected to the tubular piston and movable thereby.

In one or more embodiments described herein, the piston tubular is movable relative to the inner tubular.

In one or more embodiments described herein, the piston tubular is movable relative to the outer tubular.

In one or more embodiments described herein, the wellbore tubular is movable relative to at least one of the inner tubular and the outer tubular.

In one or more embodiments described herein, movement of tubular piston is hydraulically actuated.

In one or more embodiments described herein, the annular chamber is at about or near atmospheric pressure.

In one or more embodiments described herein, the outer tubular is adapted to transfer torque to the tubular piston.

In one or more embodiments described herein, the outer tubular is coupled to the tubular piston using a spline connection.

In one or more embodiments described herein, the tubular piston is releasably connected to the outer tubular.

In one or more embodiments described herein, a first portion of the tubular piston is disposed in the annular chamber and a second portion of the tubular piston extends below the outer tubular.

In one or more embodiments described herein, the first portion of the tubular piston has a larger diameter than the second portion of the tubular piston.

In one or more embodiments described herein, the outer tubular is disposed in a riser.

In one or more embodiments described herein, the annular chamber is less than a pressure in the riser.

In another embodiment, a tubular lifting system for lifting a wellbore tubular includes an outer tubular; an inner tubular disposed in the outer tubular; a tubular piston having a first portion disposed between the inner tubular and the outer tubular and a second portion extending beyond the outer tubular, wherein the first portion has a larger piston surface than the second portion, and wherein the wellbore tubular is connected to the tubular piston.

In one or more embodiments described herein, the first portion is selectively, axially movable between the outer tubular and the inner tubular.

In another embodiment, a method of lifting a wellbore tubular includes providing an outer tubular, an inner tubular, and a tubular piston movably disposed between the outer tubular and the inner tubular; connecting the wellbore tubular to the tubular piston; and applying a force to the tubular piston, thereby causing the tubular piston to move axially relative to the outer tubular.

In one or more embodiments described herein, the method includes severing wellbore tubular at a location below the tubular piston before applying the force.

In one or more embodiments described herein, the force comprises a pressure differential between a pressure exterior of the tubular piston and a pressure in an annular area between the outer tubular and the inner tubular.

In one or more embodiments described herein, the pressure exterior of the tubular piston comprises a pressure in a riser, and the pressure in the annular area is less than the pressure exterior.

In one or more embodiments described herein, the pressure in the annular area is at about or near atmospheric pressure.

In one or more embodiments described herein, the method includes coupling the tubular piston to the inner tubular after applying the force.

In one or more embodiments described herein, a retaining member is used to couple the tubular piston to the inner tubular.

In one or more embodiments described herein, the retaining member is a retaining ring. In one or more embodiments described herein, the retaining ring includes an axial gap. In one or more embodiments described herein, the retaining ring includes teeth for mating with teeth on the inner tubular. In one or more embodiments described herein, the retaining ring includes teeth on an exterior surface for mating with the tubular piston.

In one or more embodiments described herein, a locking member is provided to prevent the retaining ring from rotating relative to the tubular piston.

In one or more embodiments described herein, the retaining member includes a plurality of arcuate bodies having teeth.

While the foregoing is directed to embodiments of the present invention, other and further embodiments of the invention may be devised without departing from the basic scope thereof, and the scope thereof is determined by the claims that follow.

The invention claimed is:

1. A tubular lifting system for lifting a wellbore tubular, comprising:

an outer tubular;

an inner tubular disposed in the outer tubular;

an annular chamber defined between the inner tubular and the outer tubular; and a tubular piston at least partially disposed in the annular chamber and movable relative to the inner tubular, wherein the wellbore tubular is connected to the tubular piston and movable relative to the inner tubular, and wherein the tubular piston is actuated using a pressure differential between a pressure exterior of the tubular piston and a pressure in the annular chamber.

2. The tubular lifting system of claim 1, wherein movement of the tubular piston is hydraulically actuated.

3. The tubular lifting system of claim 1, wherein the annular chamber is at about or near atmospheric pressure.

4. The tubular lifting system of claim 1, wherein the outer tubular is adapted to transfer torque to the tubular piston.

5. The tubular lifting system of claim 1, wherein a first portion of the tubular piston is disposed in the annular chamber and a second portion of the tubular piston extends below the outer tubular.

6. The tubular lifting system of claim 5, wherein the first portion of the tubular piston has a larger diameter than the second portion of the tubular piston.

7. The tubular lifting system of claim 1, wherein the outer tubular is disposed in a riser.

8. The tubular lifting system of claim 7, wherein a pressure in the annular chamber is less than a pressure in the riser.

9. The tubular lifting system of claim 1, further comprising a retaining member for coupling the tubular piston to the inner tubular.

10. The tubular lifting system of claim 9, wherein the retaining member is a retaining ring.

11. The tubular lifting system of claim 9, wherein the retaining member comprises a plurality of arcuate bodies having teeth.

12. The tubular lifting system of claim 1, wherein the piston tubular is movable relative to at least one of the inner tubular, the outer tubular, or both.

13. The tubular lifting system of claim 1, wherein the wellbore tubular is movable relative to at least one of the outer tubular, the inner tubular, or both.

14. A method of lifting a wellbore tubular, comprising:

providing an outer tubular, an inner tubular, and a tubular piston movably disposed between the outer tubular and the inner tubular;

connecting the wellbore tubular to the tubular piston; and applying a force to the tubular piston, thereby causing the tubular piston to move axially relative to the outer tubular, wherein the force comprises a pressure differential between a pressure exterior of the tubular piston and a pressure in an annular area between the outer tubular and the inner tubular.

15. The method of claim 14, further comprising severing the wellbore tubular at a location below the tubular piston before applying the force.

16. The method of claim 14, wherein the pressure exterior of the tubular piston comprises a pressure in a riser, and the pressure in the annular area is less than the pressure exterior.

17. The method of claim 14, wherein the pressure in the annular area is at about or near atmospheric pressure.

18. The method of claim 14, further comprising coupling the tubular piston to the inner tubular after applying the force.

19. A tubular assembly, comprising:

a riser;

a wellbore tubular disposed in the riser; and a tubular lifting system for lifting the wellbore tubular, including:

an outer tubular;

an inner tubular disposed in the outer tubular;

an annular chamber defined between the inner tubular and the outer tubular; and a tubular piston at least partially disposed in the annular chamber and movable relative to the inner tubular, wherein the wellbore tubular is connected to the tubular piston and movable relative to the inner tubular, and wherein the tubular piston is actuated using a pressure differential between a pressure exterior of the tubular piston and a pressure in the annular chamber.

20. The tubular assembly of claim 19, further comprising a blow out preventer, wherein the wellbore tubular extends through the blow out preventer.

21. A tubular lifting system for lifting a wellbore tubular, comprising:

an outer tubular disposed in a riser;

an inner tubular disposed in the outer tubular;

an annular chamber defined between the inner tubular and the outer tubular;

a tubular piston at least partially disposed in the annular chamber and movable relative to the inner tubular, wherein the wellbore tubular is connected to the tubular piston and movable relative to the inner tubular, and wherein the tubular piston is movable to lift the wellbore tubular in response to the wellbore tubular being severed; and a retaining member for coupling the tubular piston to the inner tubular and having a plurality of arcuate bodies having teeth.

22. The tubular lifting system of claim 21, wherein a pressure in the annular chamber is less than a pressure in the riser.

23. The tubular lifting system of claim 21, wherein the retaining member is a retaining ring.

* * * * *